US005860941A

United States Patent [19]

Saringer et al.

[11] Patent Number: 5,860,941

[45] Date of Patent: Jan. 19, 1999

[54] ACTIVE/PASSIVE DEVICE FOR REHABILITATION OF UPPER AND LOWER EXTREMITIES

[75] Inventors: John H. Saringer, Markham; Jeffrey J. Culhane, Pickering; Alexander G. Solomon, Ajax, all of Canada

[73] Assignee: Orthologic Corp., Phoenix, Ariz.

[21] Appl. No.: 749,310

[22] Filed: Nov. 14, 1996

Related U.S. Application Data

[60] Provisional application No. 60/014,366, Mar. 28, 1996 and provisional application No. 60/006,719, Nov. 14, 1995.

[51] Int. Cl.[6] ..... A61H 1/00

[52] U.S. Cl. ..... 601/33; 601/23; 601/36; 482/4; 482/60; 482/64

[58] Field of Search ..... 601/5, 23, 33–36, 601/40; 482/4–9, 57, 60, 64, 904

[56] References Cited

U.S. PATENT DOCUMENTS

| | | | |
|---|---|---|---|
| 3,100,640 | 8/1963 | Weitzel . | |
| 3,713,438 | 1/1973 | Knutsen . | |
| 3,964,742 | 6/1976 | Carnielli | 601/36 |
| 4,509,742 | 4/1985 | Cones . | |
| 4,691,694 | 9/1987 | Boyd et al. | 482/900 |
| 4,717,146 | 1/1988 | Nohara . | |
| 4,938,474 | 7/1990 | Sweeney et al. | 482/64 |
| 4,961,571 | 10/1990 | Lin . | |
| 4,976,426 | 12/1990 | Szabo . | |
| 5,071,117 | 12/1991 | Mautner et al. . | |
| 5,254,060 | 10/1993 | Bohanan | 601/33 |
| 5,267,925 | 12/1993 | Boyd | 482/903 |
| 5,316,532 | 5/1994 | Butler . | |
| 5,489,250 | 2/1996 | Densmore et al. | 482/7 |
| 5,490,824 | 2/1996 | Wang | 601/36 |
| 5,580,338 | 12/1996 | Scelta et al. | 482/60 |

FOREIGN PATENT DOCUMENTS

| | | | |
|---|---|---|---|
| 194399 | 6/1985 | European Pat. Off. . | |
| 301605 | 6/1985 | European Pat. Off. . | |
| 174747 | 8/1985 | European Pat. Off. . | |
| 312207 | 9/1988 | European Pat. Off. . | |
| 403295 | 6/1990 | European Pat. Off. . | |
| 3420842 | 12/1985 | Germany | 601/36 |
| 8519150 | 12/1985 | Germany . | |
| 461839 | 10/1968 | Switzerland . | |
| 976558 | 11/1964 | United Kingdom . | |
| 2016286 | 9/1979 | United Kingdom . | |
| 2096006 | 3/1982 | United Kingdom . | |
| 84/02082 | 6/1994 | WIPO | 601/36 |

*Primary Examiner*—Jeanne M. Clark
*Attorney, Agent, or Firm*—Lynn C. Schumacher; Nancy E. Hill; Hill & Schumacher

[57] ABSTRACT

An active and continuous passive motion (CPM) devices for exercising and/or providing therapy to the upper and lower extremities comprising a frame, a disc pivotally mounted to the frame and hand or feet support members attached to the disc. A motor is provided and is coupled to the disc for rotating the disc in the active mode. A control circuit is provided for adjusting the speed of the disc in the passive mode and for adjusting the resistance to movement of the disc in the active mode.

17 Claims, 6 Drawing Sheets

ACTIVE/PASSIVE DEVICE FOR REHABILITATION OF UPPER AND LOWER EXTREMITIES

This application is related to Provisional Application Ser. Nos. 60/014,366 filed on Mar. 28, 1996 and 60/006,719 filed on Nov. 14, 1995, both filed in the names of John H. Saringer, Alexander G. Solomon and Jeffrey J. Culhane.

FIELD OF THE INVENTION

The present invention relates to activelpassive motion devices for therapeutic exercise of upper and lower extremities, and more particularly, the invention relates to active/passive motion devices for therapy of arm, leg and associated articulations.

BACKGROUND OF THE INVENTION

In recent years it has become evident that the rehabilitation and treatment of injured joints can be expedited by use of active and continuous passive motion (CPM) of the joint. Continuous passive motion entails inducing movement of certain limb portions without requiring muscle coordination, strength, or control by the patient. Numerous studies have shown that CPM of the different limbs and joints accelerates healing, and very importantly results in a fuller range of motion of the joint at the end of the course of therapy. The recovery cycle from a muscular skeletal injury progressively moves from a passive involvement to an active involvement range of motion. Therefore, a device for therapeutic treatment of joints/limbs should provide both a passive mode in which the limb is exercised by the device and an active mode for the patient to use the device to exercise the limb and joints once they become healthy enough. Furthermore the device should include an adjustable range of motion and force settings to accommodate different patient requirements.

Therefore, there is a need for a device for therapeutic active and CPM exercising of joints which can be adapted for different types of limbs and associated joints.

SUMMARY OF THE INVENTION

It is an object of the present invention to provide an active/passive device for rehabilitation of the upper and lower extremities which provides an adjustable range of motion, passive speed and active resistance.

The active/passive device forming the present invention may advantageously be used for treating a variety of injuries involving the lower and upper extremities. The rehabilitation process typically requires the patient to start with a small passive range of motion and gradually work up to a full active range of motion. The active/passive device is adapted to accommodate the complete rehabilitation needs of the patient from start (post operative) to end (return to normal activities). The devices disclosed herein can provide a full range of adjustable motion, speed and force settings and are intended for use in hospitals, clinics and patients' homes. The device can be operated on a bed, table or on the floor.

In one aspect of the invention there is provided a device for providing both active and continuous passive motion of upper and lower body extremities comprising a housing and a disc means having opposite outer faces and an axis. The device includes bearing means for mounting the disc means to the housing for rotational movement about the axis. A pair of limb support members project laterally outward from each of the outer faces of the disc means a preselectable distance from the axis. The device includes a drive means for continuously rotating the disc means in a continuous passive motion mode of the device. The drive means including means for adjusting resistance to movement of the disc means in an active mode of the device.

In another aspect of the invention there is provided a device for providing for both active and continuous passive motion of lower body extremities. The device comprises a housing and a disc means having opposed outer faces and an axis. The disc means is mounted in the housing for rotational movement about the axis. A pair of lower leg support members are provided and one projects laterally outward from the faces of the disc means a preselectable distance from the axis. Each leg support member has a cradle portion to receive therein the lower leg to support the lower leg from a user's foot up to a position spaced below the user's knee. The leg support is pivotally attached to the disc at a drive point on the leg support which is between the user's knee and an ankle and below the user's calf when the user's lower leg is resting horizontally in the leg support member. The device includes drive means for continuously rotating the disc means in a continuous passive motion mode of the device. The drive means includes means for adjusting resistance to movement of the disc means in an active mode of the device.

In another aspect, there is provided a device for providing both active and continuous passive motion of upper and lower body extremities. The device comprises a housing and a disc means having opposed outer faces and an axis. The disc means mounted in said housing for rotational movement about the axis. A pair of limb support members are attached and project laterally outward each of the faces a preselectable distance from the axis. The housing has a cut-out portion defined by an inner circumferential surface for receiving therein the disc means. The disc means includes an outer circumferential surface and a circular bearing seated between the outer circumferential surface on the disc means and the inner circumferential surface in the housing. The device includes drive means for continuously rotating the disc means in a continuous passive motion mode of the device. The drive means includes means for adjusting resistance to movement of the disc means in an active mode of the device.

BRIEF DESCRIPTION OF THE DRAWINGS

The following is a description, by way of example only, of active/passive motion devices for upper and lower extremities constructed in accordance with the present invention, reference being had to the accompanying drawings, in which.

DETAILED DESCRIPTION OF THE INVENTION

Figure 1:
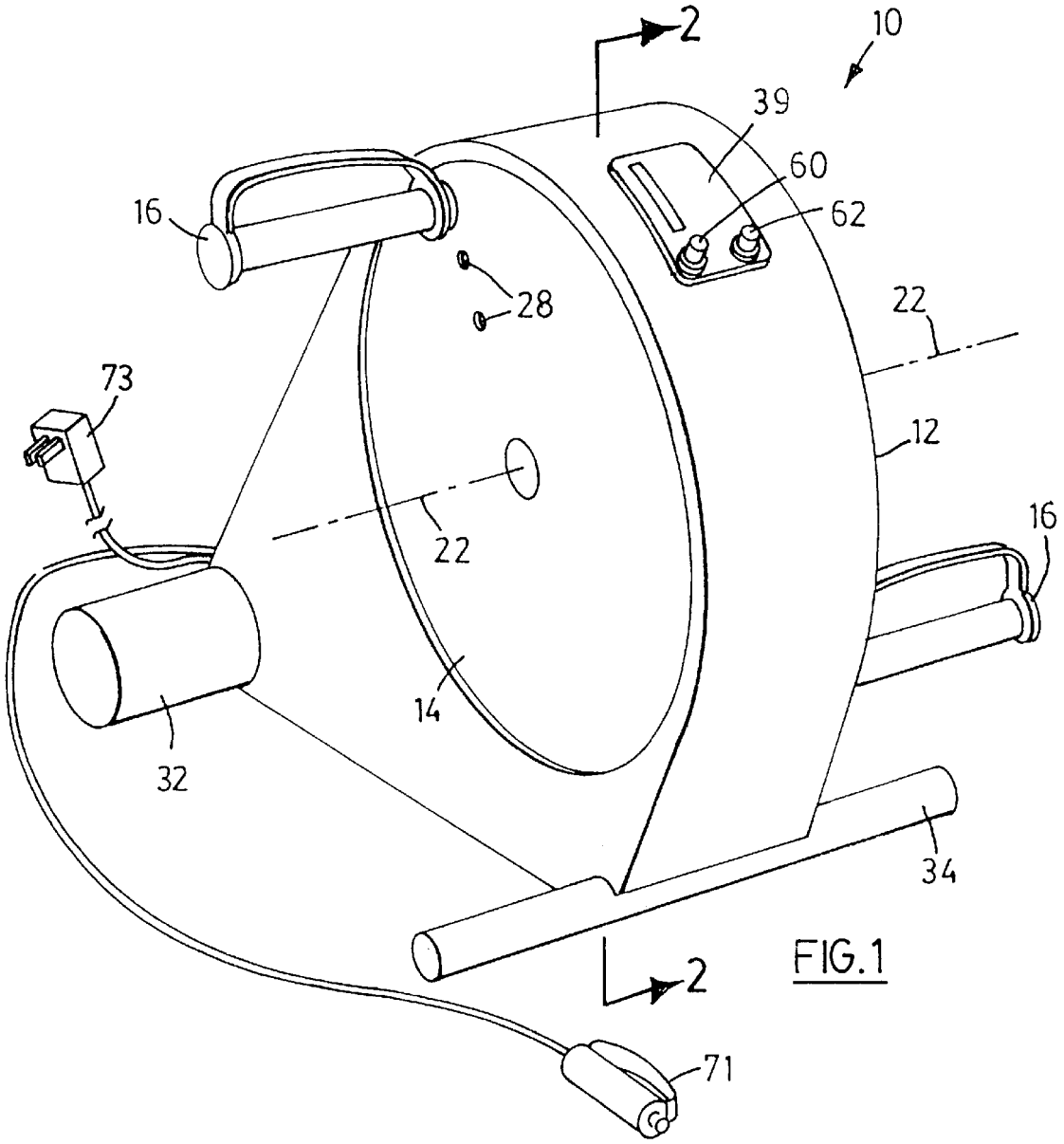
FIG. 1 is a perspective view of an active/passive device for exercising both the arms and legs according to the present invention.

Referring to FIG. 1, an active/passive motion device for exercising or therapeutic treatment of the upper and lower extremities is shown generally at 10. Active/passive device 10 includes a housing 12, a pair of discs 14 and limb supporting hand grips or pedals 16 pivotally mounted to the discs 14.

Figure 2:
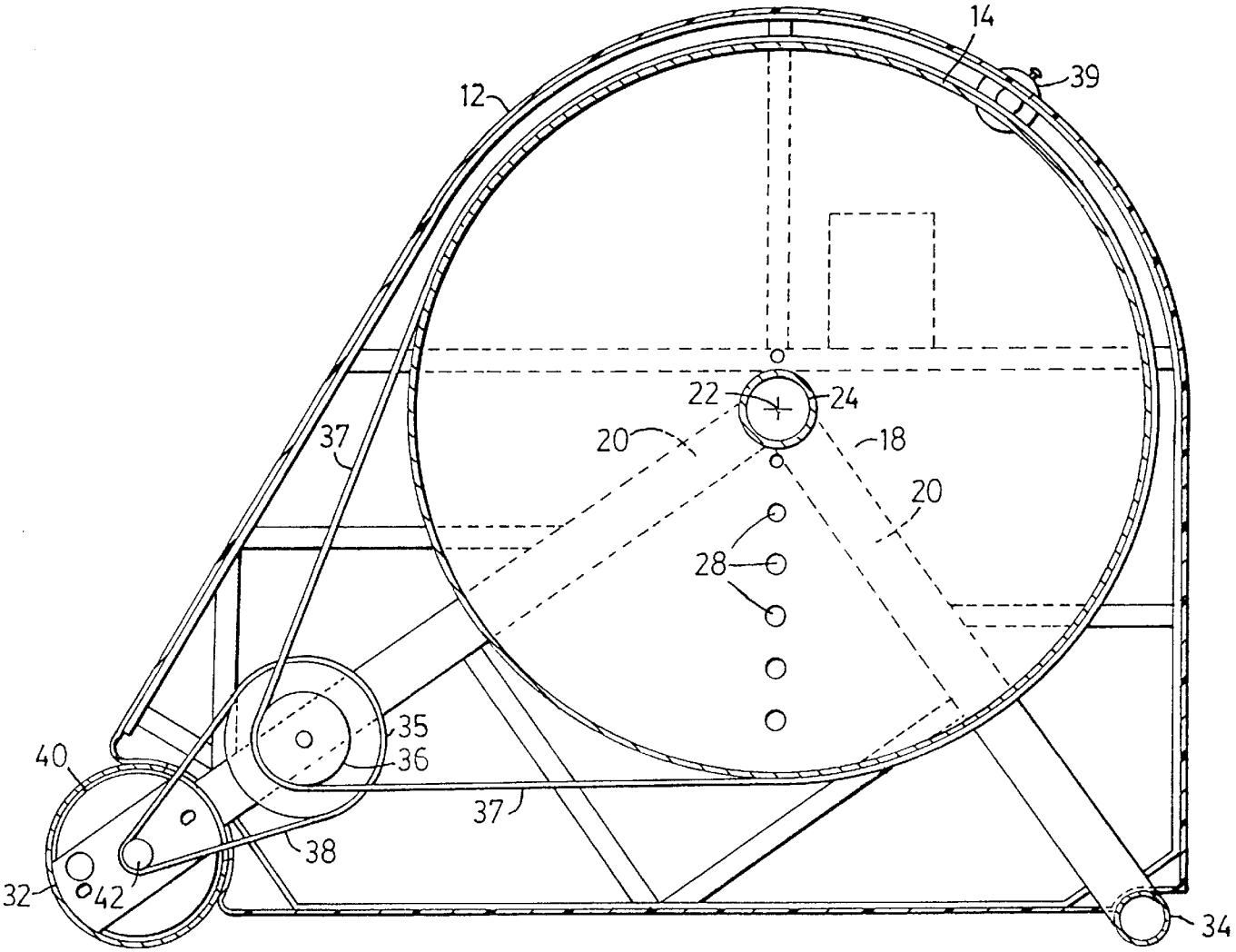
FIG. 2 is a cross-sectional view along line 2—2 of FIG. 1.

Referring to FIG. 2, each disc 14 is pivotally mounted to a frame 18 having support members 20 extending perpendicular to an axis of rotation 22 of the disc. Apparatus 10 includes a shaft and bearing assembly 24 for pivotally mounting discs 14 to frame 18. A series of holes 28 are spaced radially outwardly in the outer face of and along the diameter of discs 14. Holes 28 are adapted to receive the limb supporting hand grips or pedals 16 (FIG. 1) to permit the user to preselect the range of motion of the extremity being exercised. The corresponding holes on the opposite side of disc 14 (not shown) will extend from the centre of the disc in the opposite direction (FIG. 1) so that the handgrips are located 180° from each other about axis 22. The range of motion is adjusted by changing the location of the pivotally mounted grips 16 in the radial direction from axis 22. The range of motion of the extremities is directly proportional to the radial distance of grips 16 from the centre of the discs 14. Active/passive device 1 0 is provided with a motor 40 housed within a tube 32. Tube 32 and tube 34 located at the lower ends of frame support members 20 provide a stable base for the device. Motor 40 may be a 120 Watt, 24 VDC permanent magnet motor. Motor 40 is coupled to drive disc 14 by a reduction stage comprising pulley 35, a pulley 36, and belt 37 and belt 38. Belt 38 is coupled to motor output shaft 42 and belt 37 drives both discs 14 which are connected together.

Figures 3A, 3B:
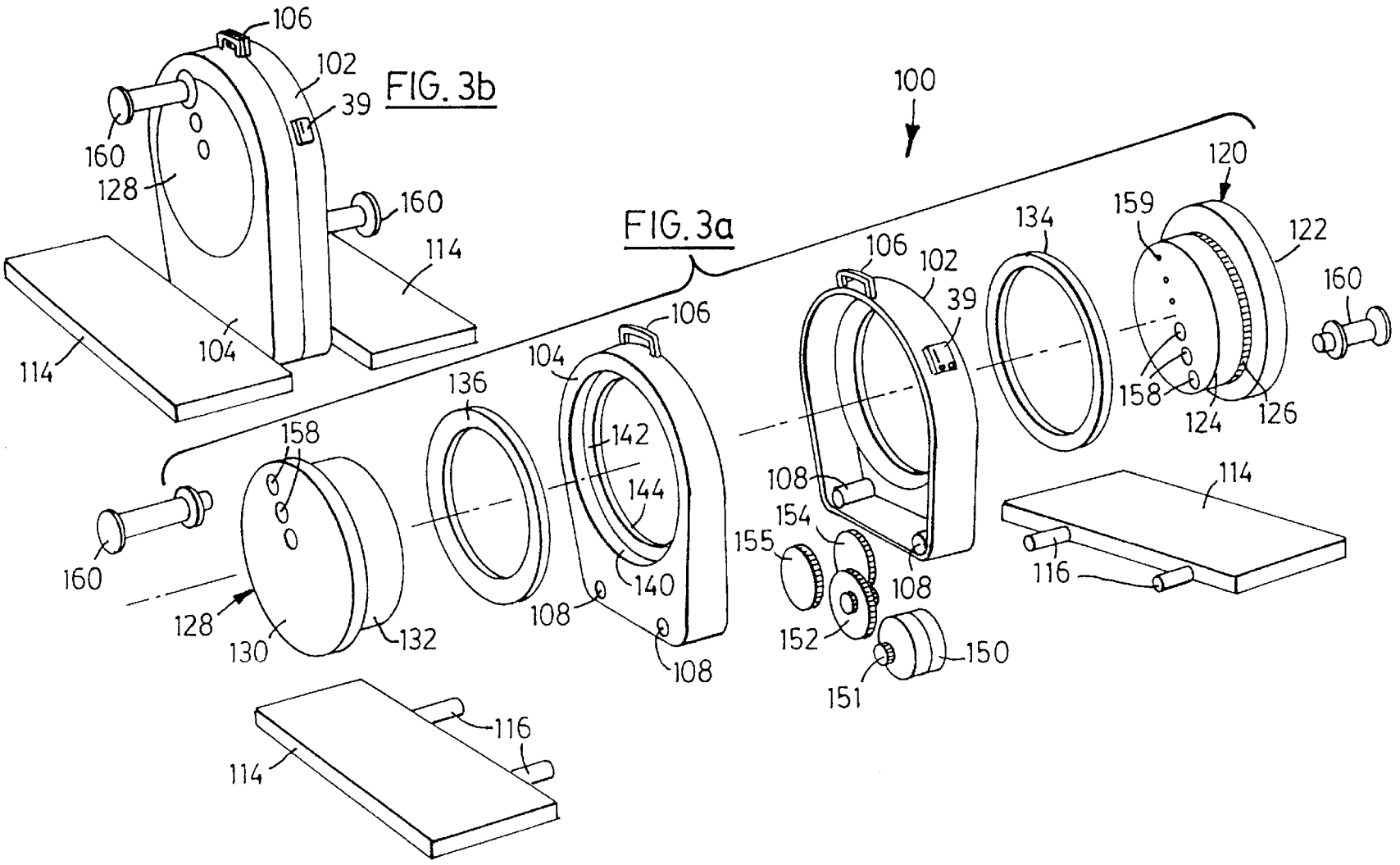
FIG. 3*a* is an exploded view of an alternative embodiment of an active/passive exercise device for both upper and lower extremities.
FIG. 3*b* is a perspective view of the device of FIG. 3*a* assembled.

Referring to FIG. 3*a* there is shown an exploded view of an alternative embodiment of an active/passive exercise device 100 for both upper and lower extremities. Exercise device 100 comprises a disc housing formed from two identical shells 102 and 104 with a carrying handle 106 at the top of the housing. Two tubes 108 are located along the bottom panel of each of the shells. A pair of base plates 114 is each provided with a pair of spaced pegs 116 which fit snugly into tubes 108 when the device is assembled (FIG. 3*b*). The drive disc comprises two identical disc sections 120 and 128. Disc section 120 includes an outer circular disc member 122 and an inner disc circular or cylindrical member 124 of smaller cross section than member 122. A gear tooth profile 126 is disposed around disc member 124. A ring bearing 134 fits over disc member 124 and a ring bearing 136 slides onto an inner disc member 132 of disc section 128. Referring to shell portion 104, an opening 140 has a diameter slightly larger than the diameter of the outer disc member 130 of disc section 128 and an annular shoulder 142 spaced from the front surface of the shell defines a smaller opening 144 with a diameter slightly larger than disc members 132 and 124 but smaller than disc members 122 and 130.

Bearings 134 and 136 may be separate manufactured components as shown in FIG. 3*a* or alternatively disc sections 120 and 128 may be provided with bearing races in disc members 124 and 132 respectively with ball bearings being installed during assembly of the device.

When assembled, the two disc sections 120 and 128 are connected concentrically by fasteners (not shown) located through spaced holes 158 into holes 159 spaced 180° from holes 158 on the mating disc section 120. The assembled disc sections 120 and 128 form a spool structure. The drive disc is now supported by, and rides on, the two ring bearings 134 and 136. An electric motor 150 has an output gear 151 drives a set of gears 152,154 and 155 with gear 154 engaging gear tooth profile 126 and gear 155 engaging a gear profile (not shown) disposed around member 132 of disc 128. Holes 158 are disposed in the outer face along the radius of the outer disc sections 122 and 130 and receive limb supporting hand grips 160, or lower leg supports (not shown) similar to support 70 shown in FIG. 6.

Active/passive device 100 shown in FIGS. 3*a* and 3*b* is very advantageous for several reasons. By supporting the disc by bearings 134 and 136 disposed about the outer diameter permits use of lighter materials compared to device 10. In device 10 the various housing and support members must be fabricated of steel or other structural materials since the discs 14 are supported on its rotational axis. Disc sections 120 and 128, by being supported around their outer edges by the large bearings 134 and 136 thereby distributing the load over the circumference of these sections. This in turn advantageously permits device 100 to be constructed of lighter materials and reduces the weight compared to device 10. The design of active/passive device 100 is also advantageously suited to high volume production in which asymmetrical injection molding is used to produce the parts which are then assembled together to produce the symmetrical active/passive device structure.

Referring again to FIGS. 1 and 3*b*, devices 10 and 100 respectively are provided with a speed control and display panel 39 so that in the passive mode the patient can set the angular rotational velocity of discs 14, 128 and in the active mode the user can set the amount of resistance offered by the discs. Referring to the block diagram of FIG. 7, a closed loop servo technique is used to control the speed of motor 40. The control system comprises an optical/magnetic encoder 44 mounted on motor shaft 42 (FIG. 2), a servo amplifier and a cross connected 'H' bridge 48. Frequency input from encoder 44 is doubled in a frequency doubler 49 and compared with a signal representative of the speed set point input to charge pump 50. The error signal is then amplified in error amplifier 52 and applied to the 'H ' bridge 48 via pulse width modulator 54 operating at a frequency of 20 KHz. The cross connected 'H ' bridge 48 drives motor 40 in the positive and negative directions alternatively at the modulation frequency. Increasing the pulse width in the positive direction, decreasing in the negative direction increases drive torque thus increasing the motor speed. Decreasing pulse width in the positive direction, increasing in the negative direction, produces a braking torque resisting the motion of the discs.

The control system provides independent control of speed in the passive mode by adjusting speed set point 60. Variable resistance to motion in the active mode is obtained by varying the maximum pulse width in the negative direction by adjusting set point 62. A safety voltage/pulse width monitor prevents the motor from rotating in the negative direction in the passive mode in order to prevent injury to the knee joint, described hereinafter. Referring to FIG. 1, device 10 includes a user operated hand held on/off switch 71 and power is provided from a wall outlet through adapter 73. Device 100 also includes these features, not shown.

Figure 7:
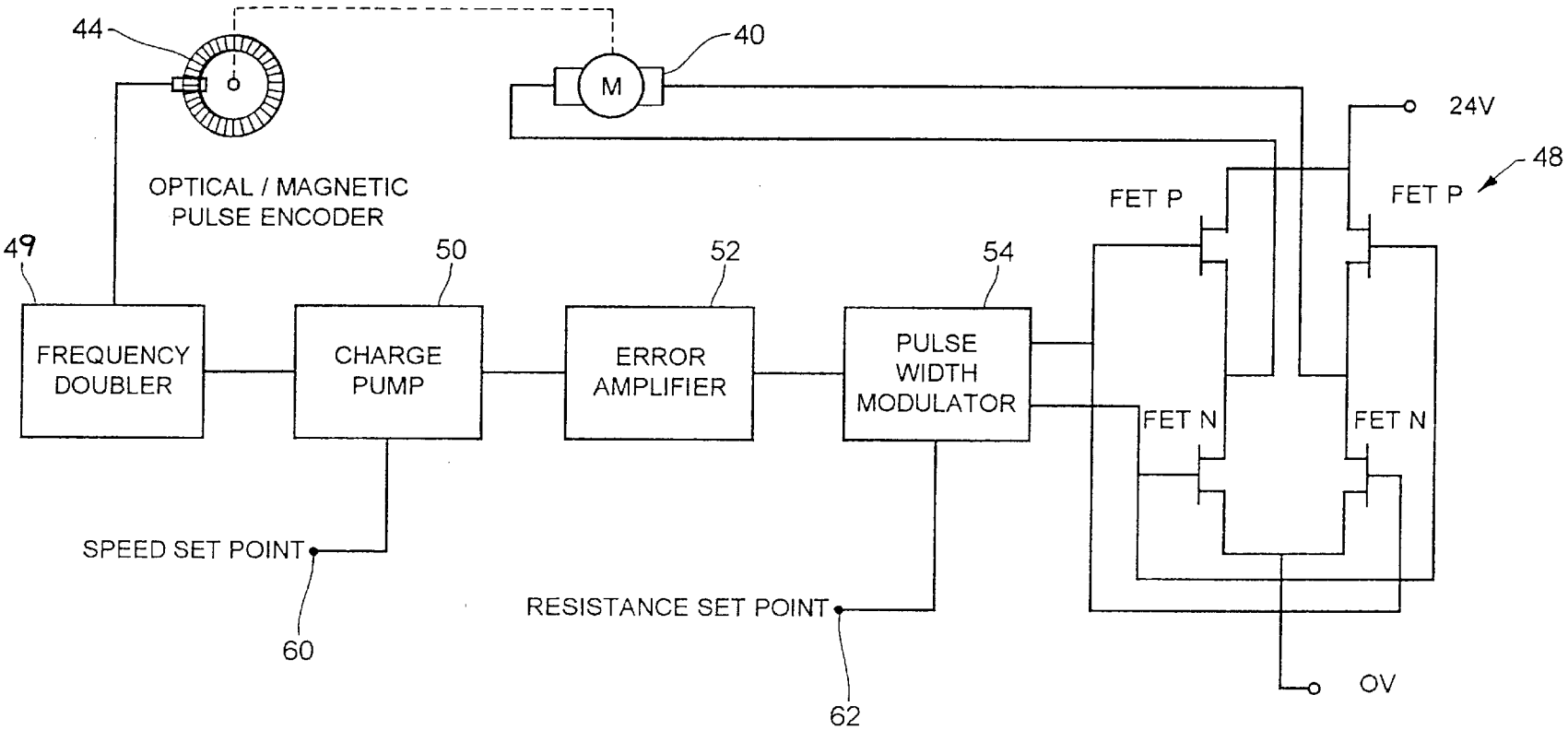
FIG. 7 is a block diagram of a control circuit used to control the operation of the active/passive device.

The motor control circuitry is designed to drive motor 40 in the positive direction only when in the passive motion mode while in the active mode when the user is driving the device the discs can be rotated in both directions. The control circuitry automatically and smoothly transfers the device from the active mode to the passive mode when a user stops moving the disc. Similarly, the device will automatically switch from the passive mode to the active mode when a user offers resistance to the discs as they drive the extremities. With reference to FIG. 7, the gain and phase compensation components in error amplifier 52 are preselected to provide a sensitive narrow band speed controller. This enables the controller to move from a fully driving mode to fully braking mode, and vice versa, for a small deviation in the motor speed from the set speed. This provides a smooth and automatic transfer between the active and passive modes without the need for the user to use remote switches.

Figure 4:
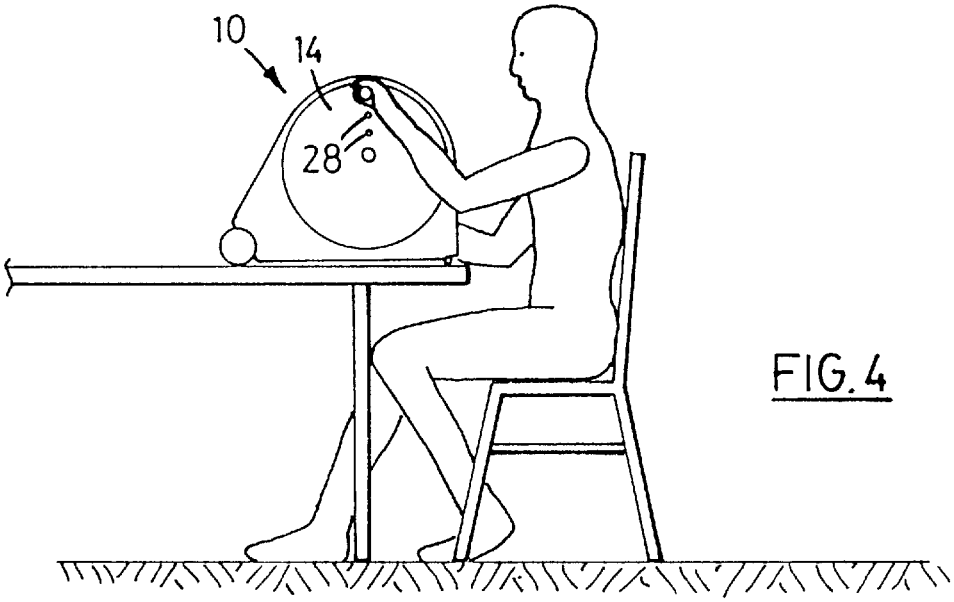
FIG. 4 is an elevational view of the device of FIG. 1 adapted for use by a user's arms.
Figure 5:
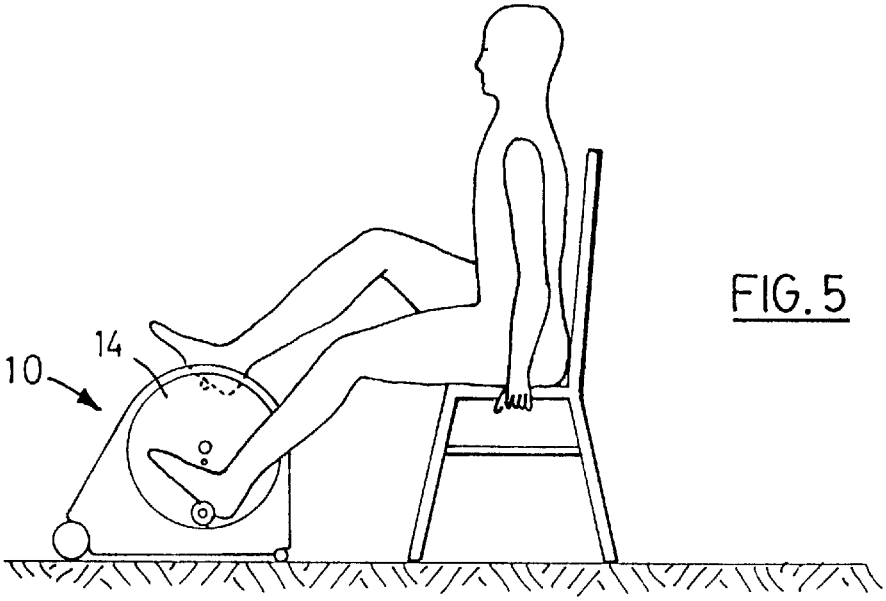
FIG. 5 is an elevational view of the device of FIG. 1 adapted for use by a user's legs.
Figure 6:
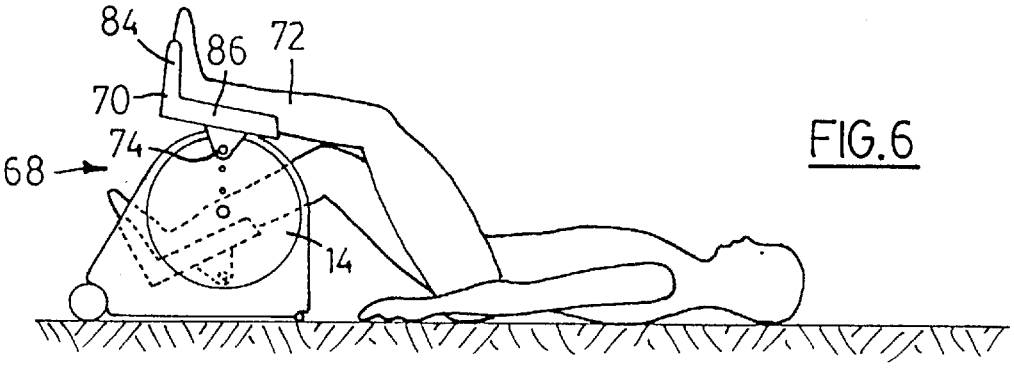
FIG. 6 is an elevational view of an alternative embodiment of the active/passive device adapted for passive use by a user's leg in the horizontal position.

Devices 10 and 100 may be used actively as an exercise machine or as a continuous passive motion (CPM) device for therapeutic treatment of the limbs and joints of the arms and legs. Referring to FIG. 4, in the active mode the patient actively rotates discs 14 by use of the mounted handgrips 16 inserted into the appropriate holes 28 to give the desired range of motion. Apparatus 10 is shown mounted on a table with the user seated during use. The user may use one, or both arms depending on the therapeutic needs. FIG. 5 shows apparatus 10 adapted for therapy or exercise of the legs utilizing a pedalling action similar to that used for the arms in FIG. 4. FIG. 6 illustrates another embodiment of the apparatus at 68 provided with a lower leg cradle support 70 in place of pedals 16. Cradle support 70 is pivotally connected to disc 14 at 74. With the lower leg of the user resting in cradle support 70, pivot point 74 is located below the calf between the ankle and knee. In the CPM mode the motor rotates discs 14 to provide CPM to the lower leg.

Conventional continuous passive motion devices (CPM) support the leg in a cradle throughout its entire length. Typically the cradle and knee share a common pivot point The leg rests on the cradle and receives whatever motion the cradle travels through. This method of supporting the leg requires a cradle structure and a platform for the cradle to move upon. These components add volume, complexity and cost to the CPMs. The present activelpassive device can provide motion to the knee without a cradle.

Figure 8:
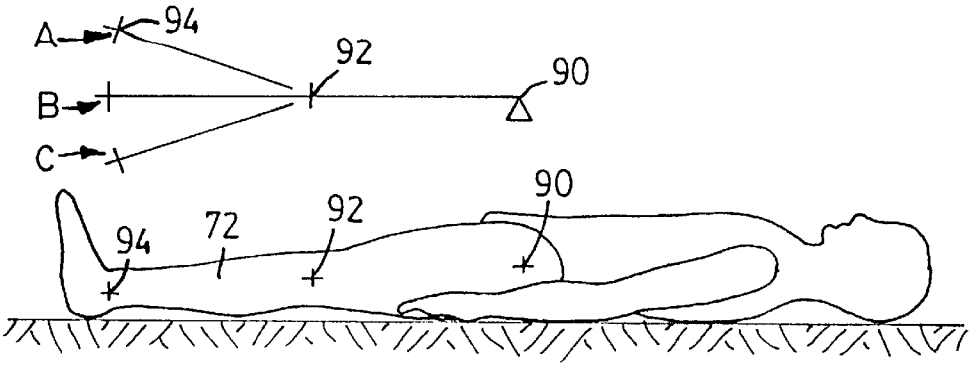
FIG. 8 is a diagrammatic representation of a leg from hip to foot in three positions.

FIG. 8 is a diagrammatic representation of the user's leg with the hip 90 fixed in a position and allowed to pivot. The knee 92 and ankle 94 are movable pivot points interconnected by the lower limb segment 72. If a force is applied along the direction of arrow A the knee 92 will be driven into hyperextension. The ankle 94 will rotate towards hip 90 forcing the knee 92 to rotate in the opposite direction to which it naturally rotates which could potentially damage the knee. A force applied along the direction of arrow B would result in no rotational motion at knee 92 but only compression along the line of action through the pivot points of the ankle, knee and hip. A force applied along the direction of arrow C will produce rotation at the pivot point in the knee 92 as the pivot point in ankle 94 moves toward the fixed pivot point of hip 90.

Figure 9:
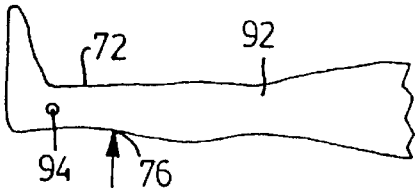
FIG. 9 shows a user's leg indicating where the support/pivot point is most advantageously located between the ankle and knee, shown horizontally, in accordance with the present invention.
Figure 10:
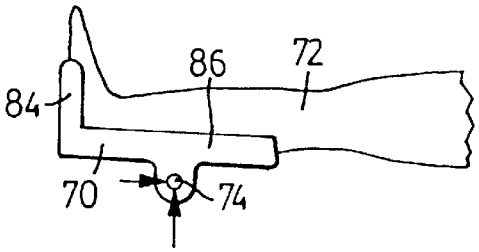
FIG. 10 is similar to FIG. 9 including a lower leg support used with the apparatus of FIG. 6 illustrating relative vertical and horizontal position between the drive point and the user's lower leg.

Referring to FIGS. 9 and 10, placing the support/pivot point 74 (FIG. 10) for the leg support 70 under the lower leg at 76 (FIG. 9) spaced away from the ankle 94 reduces the unsupported weight of the leg at the pivot point of knee 92 and reduces the knee's natural locking ability under its own weight. When combined, the optimal line of action and the support point location result in a cradleless leg support that can effectively provide motion to the lower leg. Shifting the support/pivot point 76 toward the knee 92 away from the ankle 94 reduces the resultant force acting vertically downwardly at the knee. The amount of distance the support/pivot point is shifted toward the knee should not extend past the centre of gravity of the leg segment 72 between the ankle and knee since some load on the knee is required for a controlled range of motion.

Referring to FIGS. 6 and 10, a very advantageous feature of the present invention relates to leg support 70 being provided with a shape and geometry for the lower leg 72 that supports the user's leg and foot in such a way to permit lower leg movement without ankle flexion during movement. The lower leg support 70 includes a shoe portion 84 and a cradle portion 86 for the lower leg so that the user's foot remains fixed with respect to the rest of the lower leg during movement. The leg support 70 supports the lower leg 72 and effectively controls the complete leg when it undergoes passive motion. The foot is supported laterally to maintain neutral hip rotation of the leg.

Another significant advantage of the active/passive device disclosed herein relates to the location of pivot point 74 of the lower leg support boot 70 connected to disc 14 (FIG. 6) as discussed above. This is important for providing a safe range of motion to the leg. When the user's leg 72 is in extension (leg is straight with no knee flexion) the knee locks under its own weight. This occurs when the hip 90, ankle 94 and knee joint 92 share the same line of action, (FIG. 8, arrow B). Hyperextension occurs when the knee pivot falls below the line of action of the hip and ankle and is also an example of a locked knee geometry. (FIG. 8, arrow A)

Figure 11:
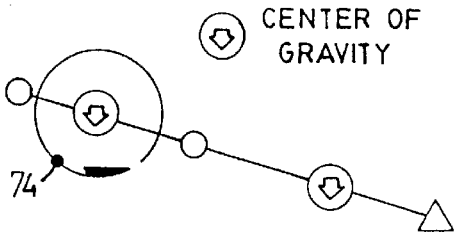
FIG. 11 is a diagrammatic representation of a leg in the active/passive device constructed in accordance with the present invention showing the positions of the centre of gravity for the different sections of the leg.

Referring to FIG. 11, another significant advantage of the present device is the way in which lower leg support 70 is driven. The concept involves rotational motion which is ideal for rehabilatory modalities which can be performed with the device. To provide passive motion to the lower leg two features must be considered: 1 ) how the leg is supported as discussed above, and 2 ) the direction in which discs 14 (or discs 120 and 128) rotate. The leg is preferably supported in the manner described above (FIG. 6). When the leg is supported at its extremes (hip and ankle), a change in flexion is the result of changing the relative distance between these two points. This change in distance is dictated by the diameter of the drive disc where the diameter equals the stroke (change in relative distance) which effectively dictates the range of motion. The second feature is the choice of rotational direction of the drive discs. This is very important in order to reduce the likelihood of the knee locking or going into hyper-extension. The knee is most susceptible to injury when it is fully extended, especially post-operatively. In considering which rotational direction to drive the knee, minimizing the stress on the fully extended knee is critical.

Figure 12A:
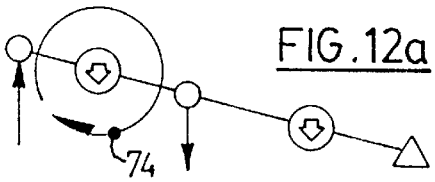
FIG. 12*a* is similar to FIG. 11 showing the direction of motion of the ankle and knee for clockwise rotation of the disc in FIG. 6.
Figure 12B:
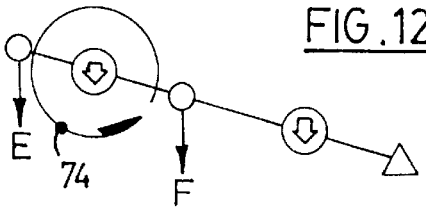
FIG. 12*b* is similar to FIG. 11 showing the direction of motion of the ankle and knee for counterclockwise rotation of the disc in FIG. 6.

Referring to FIGS. 12*a* and 12*b*, if the knee is driven clockwise (FIG. 12*a*) the support point 74 accelerates upwards placing an additional hyperextensive load on the fully extended knee. In this situation the moving support point 74 is being driven away from the hip to generate extension. The accelerated lifting and traction force on the knee in extension can induce hyperextension causing pain or injury to the knee. In contrast, if the device is driven to provide counterclockwise movement of the support point 74 (FIG. 12*b*), there will be less of a hyperextensive load on the knee. In this direction the fully extended leg is accelerating in the same direction in which gravity is acting thereby reducing the net force on the leg and more importantly the extended knee. The knee is accelerated upwardly in a flexed position thereby minimizing the chances of injury.

Therefore what is claimed is:

1. A device for providing both active and continuous passive motion of upper and lower body extremities, comprising:

a) a housing;

b) disc means having opposite outer faces and an axis, bearing means for mounting said disc means to said housing for rotational movement about said axis, a pair of limb support members projecting laterally outward from opposite ones of said outer faces of said disc means a radial distance from said axis, said limb support members including an interchangeable pair of hand support members and leg support members, and means for adjusting the radial distance of each limb support member from said axis thereby adapting the device to permit adjustment in a range of motion of a user's limbs; and c) drive means for continuously rotating said disc means in a continuous passive motion mode of the device, and means for adjusting resistance to movement of said disc means in an active mode of the device.

2. The device according to claim 1 wherein said pair of hand support members are handgrips located 180° from each other relative to said axis.

3. The device according to claim 2 wherein said drive means includes an electric motor connected to said disc means and said means for adjusting resistance to movement of said disc means including a motor control means connected to said electric motor, said motor control means also controlling said electric motor to adjust a rotational speed of said disc means in the passive mode of said disc means.

4. The device according to claim 3 wherein said motor control means includes narrow band speed control means for switching said electric motor between a fully driving mode and a fully braking mode and vice versa for a preselected deviation in a motor speed from a preselected set speed of said electric motor.

5. The device according to claim 4 wherein said disc means comprises two molded disc sections, each molded disc section comprising a first circular section and a second cylindrical section concentric with said first circular section, said second cylindrical sections having a diameter less than a diameter of said first circular sections and having outer circumferential surfaces, said bearing means comprising two circular bearings, one bearing seated on each of said outer circumferential surfaces, and said two molded disc sections being secured together.

6. The device according to claim 5 wherein at least one of said disc sections comprises a geared tooth profile disposed about said outer circumferential surface of said second cylindrical section, and gear means driven by said electric motor for engaging said geared tooth profile.

7. The device according to claim 4 wherein said drive means includes a system of pulleys and belts connecting said disc means to said electric motor.

8. The device according to claim 4 wherein said motor control means includes means for limiting a maximum drive period in a negative direction to provide variable resistance to said disc means in the active mode.

9. The device according to claim 1 wherein each of said leg support members includes a cradle portion adapted to receive and support a user's leg therein from the user's foot to a position spaced below the user's knee, each cradle portion being pivotally attached to said disc means at a drive point on said leg support member which is adapted to be between the user's knee and the user's ankle below user's calf when the user's lower leg is resting horizontally in said cradle portion.

10. The device according to claim 9 wherein said drive means includes an electric motor connected to said disc means and said means for adjusting resistance to movement of said disc means including a motor control means connected to said electric motor, said motor control means also controlling said electric motor to adjust a rotational speed of said disc means in the passive of said disc means.

11. The device according to claim 10 wherein said motor control means includes narrow band speed control means for switching said electric motor between a driving mode and a braking mode and vice versa for a preselected deviation in a motor speed from a preselected set speed of said electric motor.

12. The device according to claim 1 wherein said housing includes at least one base plate extending from said housing and means for securing said base plate to said housing to thereby stabilize said housing with respect to a support surface.

13. A device for providing for both active and continuous passive motion of lower body extremities, comprising:

a) a housing;

b) a disc means having opposed outer faces and an axis, said disc means mounted in said housing for rotational movement about said axis, a pair of lower leg support members, said pair of lower leg support members being releasibly attached and projecting laterally outward from opposite ones of said outer faces of said disc means a radial distance from said axis, means adapted to adjust a range of motion for a user's lower leg by permitting the radial distance of each leg support member from said axis to be adjustable, each leg support member having a cradle portion adapted to receive and support therein the user's lower leg from the user's foot to a position spaced below the user's knee, each leg support member being pivotally attached to said disc at a drive point on said leg support member which is adapted to be between the user's knee and an ankle and below the user's calf when the use's lower leg is resting horizontally in said leg support member; and c) drive means for continuously rotating said disc means in a continuous passive motion mode of the device, and means for adjusting resistance to movement of said disc means in an active mode of the device.

14. The device according to claim 13 wherein said disc means comprises two molded disc sections, each molded disc section comprising a first circular section and a second cylindrical section concentric with said first circular section and integrally formed therewith, said second cylindrical sections having a diameter less than a diameter of said first circular sections and having outer circumferential surfaces, said bearing means comprising two circular bearings, one bearing seated on each of said outer circumferential surfaces, and said two molded disc sections being secured together.

15. The device according to claim 14 wherein at least one disc section comprises a geared tooth profile disposed about said outer circumferential surface of said second cylindrical section, and gears being driven by said drive means for meshing with said geared tooth profile.

16. The device according to claim 13 wherein said drive means includes an electric motor connected to said disc means and said means for adjusting resistance to movement of said disc means including a motor control means connected to said electric motor, said motor control means also controlling said electric motor to adjust a rotational speed of said disc means in the passive mode and for adjusting the resistance to movement of said disc means in the active mode.

17. The device according to claim 16 wherein said motor control means includes a narrow band speed controller for switching said electric motor between a fully driving mode and a fully braking mode and vice versa for a preselected deviation in a motor speed from a preselected set speed of said electric motor.

* * * * *